US006427299B2

(12) United States Patent
Tanaka et al.

(10) Patent No.: US 6,427,299 B2
(45) Date of Patent: Aug. 6, 2002

(54) SAMPLE WARPER, WARPING METHOD AND GROUP OF WARPED YARNS

(75) Inventors: Yoshihiro Tanaka; Takatsugu Aihara, both of Kiryu (JP)

(73) Assignee: Suzuki Warper, Ltd., Gunma-ken (JP)

( * ) Notice: Subject to any disclaimer, the term of this patent is extended or adjusted under 35 U.S.C. 154(b) by 0 days.

(21) Appl. No.: 09/842,914

(22) Filed: Apr. 27, 2001

(30) Foreign Application Priority Data

Jun. 1, 2000 (JP) ..... 2000-164572

(51) Int. Cl.[7] ..... D02H 3/00
(52) U.S. Cl. ..... 28/190
(58) Field of Search ..... 28/184, 190, 172.1, 28/191, 192, 198, 199

(56) References Cited

U.S. PATENT DOCUMENTS 4,074,404 A * 2/1978 Schenk ..... 28/190
5,950,289 A * 9/1999 Tanaka ..... 28/190
6,233,798 B1 * 5/2001 Bogucki-Land ..... 28/190

FOREIGN PATENT DOCUMENTS

DE 03514701 A1 * 10/1985 ..... 28/190
DE 40 17 359 C1 8/1991
DE 004422098 A1 * 1/1996 ..... 28/190
DE 44 46 279 C1 6/1996
DE 019605924 A1 * 8/1997 ..... 28/190
EP 0375480 A2 * 6/1990 ..... 28/190
EP 0 375 480 A2 6/1990
EP 0 652 310 A1 5/1995
EP 0 933 455 A2 8/1999

* cited by examiner

*Primary Examiner*—Danny Worrell
(74) *Attorney, Agent, or Firm*—Arent Fox Kintner Plotkin & Kahn

(57) ABSTRACT

Provided are a sample warper and a warping method where data regarding yarn diameters of counts are preliminarily input and stored, counts of warping yarns as well as pattern data for warping are input, a conveyor belt feed pitch per revolution of a yarn introduction means is calculated with a warping width, the number of warping yarns, and a warping length (the number of warping windings), and the conveyor belt feed pitch per revolution of the yarn introduction means is controlled according to the counts (yarn thicknesses or yarn diameters). Accordingly, a surface of the yarns wound on a warper drum is finished in a flat state without undulation irrespective of the counts, thereby solving troubles in the next weaving step.

7 Claims, 9 Drawing Sheets

SAMPLE WARPER, WARPING METHOD AND GROUP OF WARPED YARNS

BACKGROUND OF THE INVENTION

1. Field of the Invention

The present invention relates to a sample warper and a warping method where feed of a conveyor belt is changed according to a count (yarn thickness) of a yarn to be warped so that there can be canceled surface undulation of finished winding of the yarn which has been wound on a warper drum to achieve flat finishing.

2. Description of the Related Art

As a conventional sample warper (W), there has been known a structure shown in FIGS. 8–10, disclosed in Japanese Patent No. 1529104, etc. The sample warper (W) of FIG. 8 comprises: a warper drum (A); a single yarn introduction means 6, rotatably mounted on one side surface of the warper drum (A) for winding a yarn on the warper drum (A); a plurality of yarn selection guides 27 associated with the yarn introduction means 6 and mounted on an end of a base (Y) supporting the warper drum (A) for moving angularly movable to project to a yarn exchanging position and retract to a standby position during yarn changing; a fixed creel (B) for supporting a plurality of bobbins (N) which are associated with the plural yarn selection guides 27 and on which the same kind or different kinds of yarns 22 are to be wound, thereby passing the yarns 22 between the yarn introduction means 6 and the yarn selection guides 27 so that the yarns are automatically changed and successively wound neatly on the warper drum (A) according to preset pattern data (yarn order).

In the sample warper (W), the plural yarn selection guides 27 receive the plural yarns 22, respectively, so that the individual yarns 22 of the fixed creel (B) can be successively wound on the warper drum (W) in a fully controlled manner. Reference numeral 17 designates a plurality of conveyer belts movably mounted on a circumferential surface of the warper drum (A). A feed rate of the conveyor belt 17 is controlled by a conveyor belt feed means, that is, a conveyor belt feed motor later described. A plurality of parallel shedding members (a plurality of parallel shedding bars 38*a* to 38*g*) are longitudinally extending alongside of the warper drum (A).

This known sample warper (W) has a hollow shaft 1 (FIG. 9). Driving and driven shafts 2, 3 project centrally from opposite ends of the hollow shaft 1. A small gear 5 fixed to a pulley 4 and a pulley 99 are loosely mounted on the driving shaft 2, while a small gear 7, to which a yarn introduction means 6 is fixed, is loosely mounted on the driven shaft 3 at the distal end. While the illustrated example shows only one yarn introduction means 6, two or more yarn introduction means 6 must be disposed for a plural-winding system.

The small gears 5, 7 are associated with each other through small gears 9, 10 disposed at opposite ends of an associating shaft 8 extending through the hollow shaft 1, which small gears 9, 10 are meshed with the corresponding small gears 5, 7. The hollow shaft 1 is cantilevered at the driving shaft 2, and a warper drum (A) is loosely mounted on the hollow shaft 1 on the driven shaft 3 side.

The warper drum (A) is formed of drum frames 13, 14 having an outer periphery of like shape having alternately an arcuate portion and a straight portion; a pair of rollers 15 disposed one on the arcuate portion of each of the drum frames 13, 14; and horizontal beams 16 carrying the rollers 15 around which conveyor belts 17 are wound. The conveyor belts 17 are moved along a plane formed by the horizontal beams 16.

The conveyer belts 17 are simultaneously driven to a common amount of fine movement by a drive member 21 threadedly engaged with interior screw shafts 20 of planetary gears 19 concurrently rotated by meshing with a sun gear 18 suitably driven from the exterior. A feed rate of the conveyor belt 17 may be controlled by a control unit controlling a conveyor belt moving motor 51 later described, that is, a conveyor belt feed means. The distal end of the yarn introduction means 6 is bent inwardly to provide a yarn introducing member 6' which is disposed adjacent to the front end of the outer periphery of the warper drum (A).

Referring to FIG. 9, (B) designates a fixed creel for supporting a plurality of bobbins around which different kinds (different colors or different twists) of yarns 22 are wound; 24, a guide plate for guiding yarns 22 drawn out from the bobbins; 25, a tension regulator for regulating the tension of the yarns 22; 26, a dropper ring; 30, a guide rod for the yarns 22; and (E), a yarn fastener having a permanent magnet mounted to a base (Y) for pressing and setting the yarns.

Referring again to FIG. 9 reference numeral 46 designates a main motor implemented by an invertor motor for enabling, during operation of the warper, acceleration and deceleration, buffer start/stop, jogging operation and an increased winding speed.

Further in FIG. 9, reference numeral 47 designates a main speed change pulley; 58, a V belt wound on and between the main speed change pulley 47 and an auxiliary speed change pulley 48; 49, a counter pulley which is coaxial with the auxiliary speed change pulley 48; and 50, a brake actuating pinion for reciprocatingly moving a rack to bring the rack into and out of engagement with a brake hole (not shown) in a brake drum (D), thus controlling the warper drum (A) as desired. Reference numeral 57 designates a belt between pulleys 4 on the driving shaft 2; 51, a conveyor belt moving motor (AC servo motor); 52, a shift lever; 54 a sprocket-wheel; 55, a chain; 56, a chain wheel for driving the sun gear 18; 57, 58, both V belts; 59, a front cover; 59*a*, a front guide rod; and (D), the brake drum. Reference numerals 67*a*, 67*b* designate sensors for detecting the passing of the slit of the slitted plate 28.

Referring next to FIG. 10, reference numeral 69 designates a movement/stopping change-over lever for the conveyor belts 17; 70, a locking lever for locking the warper drum (A); 74, a shedding bar adjusting lever; 75, a shedding bar locking handle; 78, a program setting unit; 79, a controller; 80, a yarn tensioning unit located centrally on the straight part 12 of the warper drum (A); and (C), a rewinder.

The controller 79 is a control unit for controlling the sample warper and may control various apparatus connected thereto in accordance with a program set by a program setting unit 78. The basic structure and operation of the sample warper (W) are well known as by the above-mentioned Japanese Patent, etc., so their detailed description is omitted here. As the conveyor belt 17, needless to say, there may be applied an endless conveyor belt mechanism as disclosed in Japanese Patent Laid-open Publication No. 11–315439.

As disclosed in the above Japanese Patent, feed of the conveyor belt in the sample warper of this kind is controlled by a conveyor belt feed control unit on the basis of the feed rate of the conveyor belt, namely, a feed pitch $P_1$, per revolution of the yarn introduction means calculated according to data input of warping width, the number of warping yarns, and warping length (the number of warping windings).

In the above-mentioned sample warper, however, the feed rate of the conveyor belt, or the feed pitch (P), per revolution of the yarn introduction means is calculated according to the following equation (1) on the basis of the warping width, the total number of yarns to be warped and the warping length (the number of warping windings), so that it becomes the same pitch irrespective of a count (yarn thickness).

Warping width=P(feed pitch)×the number of warping windings×the total number of yarns to be warped: Q(warping density)=P(feed pitch)×the number of warping windings: Warping density (Q)=warping width÷the total number of yarns to be warped: (P)=warping density (Q)÷the number of warping windings

. . . (1)

For this reason, as shown in FIG. 6, when yarns ($A_1$) to ($A_5$) and yarns ($B_1$) to ($B_5$) of the same count (the same thickness) are used to perform one winding warping, a surface contour of the wound yams is flat. Incidentally, in FIG. 6, warping density (Q)=feed pitch (P). Also, even when warping of yarns ($A_1$) to ($A_5$) and ($B_1$) to ($B_5$) of the same count is performed, for example, under the same condition of warping density (Q)=yarn diameter (d) as above and with warping length of five windings (the warping condition shown in FIG. 5), a surface contour of the wound yarns is flat (FIG. 7). In FIG. 7, warping density (Q)=feed pitch (P)×5.

However, when yarns ($A_1$) to ($A_5$) (thick yarns) and yarns ($B_1$) to ($B_5$) (thin yarns) different in the count (yarn thickness) from each other are used to perform one winding warping under the condition of warping density Q=yarn diameter d of the yarns (A), for example, as shown in FIG. 4 the wound yarn state of the thick yarn portion, namely the portion of the yarns ($A_1$) to ($A_5$) is thick, while the wound yarn state of the thin yarn portion, namely the portion of the yarns ($B_1$) to ($B_5$) is thin, so that a surface contour of the wound yarns is undulated.

Also, when both the yarns are warped from the state shown in FIG. 4 with a warping length of five windings (under the warping condition shown in FIG. 5), as shown in FIG. 3 the wound yarn state of the thick yarn portion, namely the portion of the yarns ($A_1$) to ($A_5$) is further thick, while the wound yarn state of the thin yarn portion, namely, the portion of the yarns ($B_1$) to ($B_5$) is much thinner than the thickness of the portion of the yarns ($A_1$) to ($A_5$), so that the surface contour of the wound yarns becomes a largely undulated state.

In the case that the surface contour of the yarns wound on a warper drum becomes an undulated state, the circumferential lengths of the respective yarn layers differ from one another comparing the thick yarn portion with the thin yarn portion. As a result, rewinding the yarns wound on the warper drum on a beam of a rewinder, the difference in circumferential lengths of the yarns leads to a rewinding tension difference, and rewinding the yarn from the warper drum with a large diameter to the beam with a small diameter, the difference in undulation of the surface contour of the wound yarn results in a further large difference in surface undulation of the yarns rewound on the beam, which causes big troubles in a next weaving step.

SUMMARY OF THE INVENTION

With the foregoing drawbacks of the prior art in view, it is an object of the present invention to provide a sample warper and a warping method where data regarding yarn diameters of counts are preliminarily input and stored, counts of warping yarns as well as pattern data for warping are input, a conveyor belt feed pitch per revolution of a yarn introduction means is calculated with a warping width, the total number of yarns to be warped, and a warping length (the number of warping windings), and the conveyor belt feed pitch per revolution of the yarn introduction means is controlled according to the counts (yarn thicknesses or yarn diameters) so that a surface of the yarns wound on a warper drum is finished in a flat state without undulation irrespective of the counts, thereby solving the above troubles in the next weaving step.

To attain the foregoing object, according to the present invention, there is provided a sample warper where catching yarns by at least one yarn introduction means and exchanging the yarns, the yarns are wound on a conveyor belt moving on a warper drum at a predetermined feed rate to perform design warping, wherein when warping yarns of different counts (different thicknesses), a feed rate of the conveyor belt is controlled according to diameters (thicknesses) of the respective yarns so that a surface contour of the yarns wound on the warper drum is finished in a flat state irrespective of the yarn diameters of the different counts.

According to the present invention, there is also provided a warping method using a sample warper where catching yarns by at least one yarn introduction means and exchanging the yarns, the yarns are wound on a conveyor belt moving on a warper drum at a predetermined feed rate to perform design warping, wherein when warping yarns of different counts (different thicknesses), a feed rate of the conveyor belt is controlled according to diameters (thicknesses) of the respective yarns so that a surface contour of the yarns wound on the warper drum is finished in a flat state irrespective of the yarn diameters of the different counts.

Movement of the conveyor belt is controlled such that when warping a thick yarn of a large diameter, the conveyor belt is moved with an increased feed rate, and when warping a thin yarn of a small diameter, the conveyor belt is moved with a decreased feed rate, so that the surface contour of the yarns wound on the warper drum can be finished in a flat state without undulation irrespective of the counts.

According to the present invention, there is further provided a group of warped yarns wherein a surface of yarns wound on a warper drum are finished in a flat state irrespective of yarn diameters of different counts.

DETAILED DESCRIPTION OF THE PREFERRED EMBODIMENTS

Embodiments of the present invention will be explained below with reference to the drawings. These embodiments are merely illustrative, and the present invention may be modified or changed variously without departing the scope or spirit of the technical idea of the present invention or the appended claims.

Figure 1:
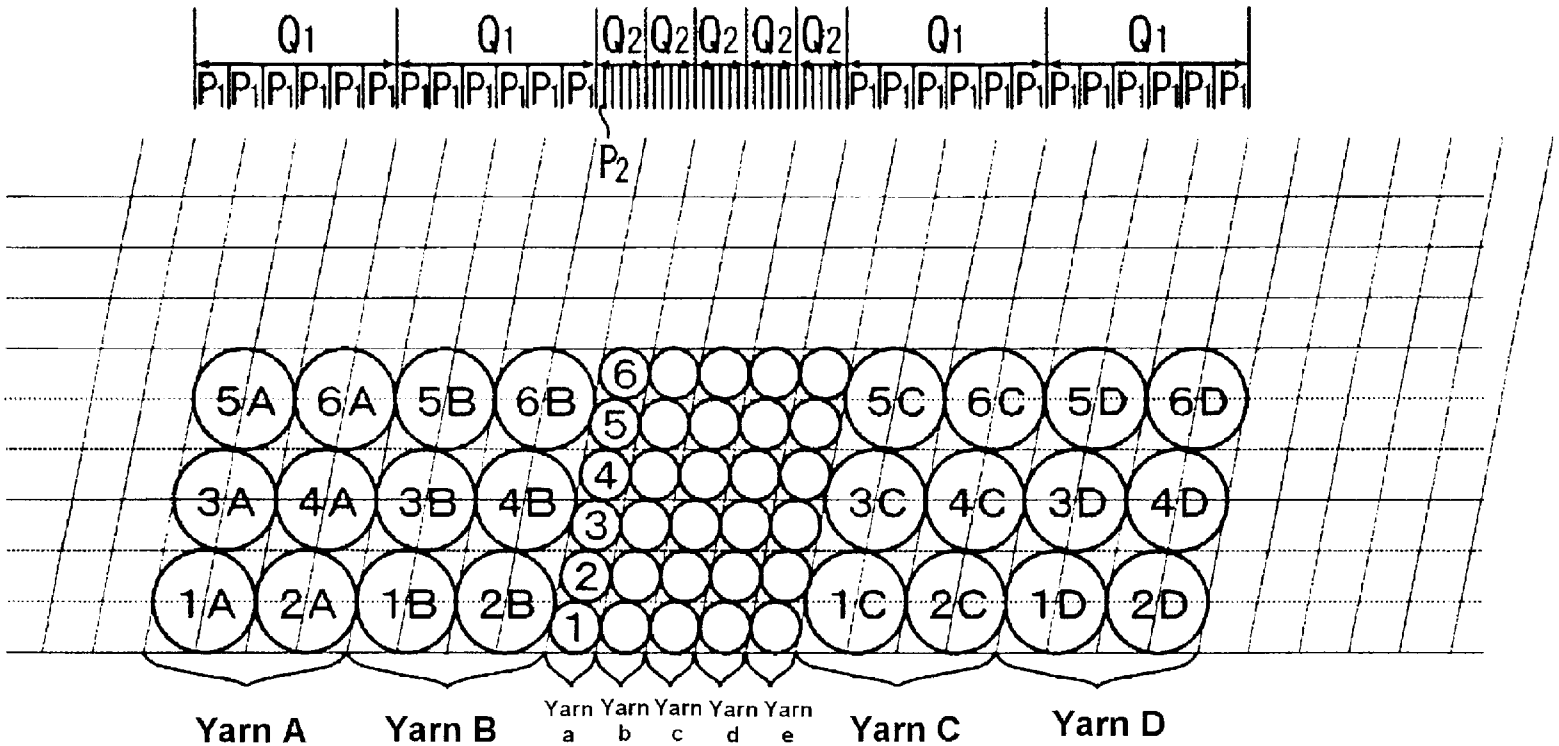
FIG. 1 is a sectional explanatory diagram showing a wound contour of a group of warping yarns corresponding to a feed pitch of a conveyor belt in six windings of yarns warped according to a warping method of the present invention.
Figure 2:
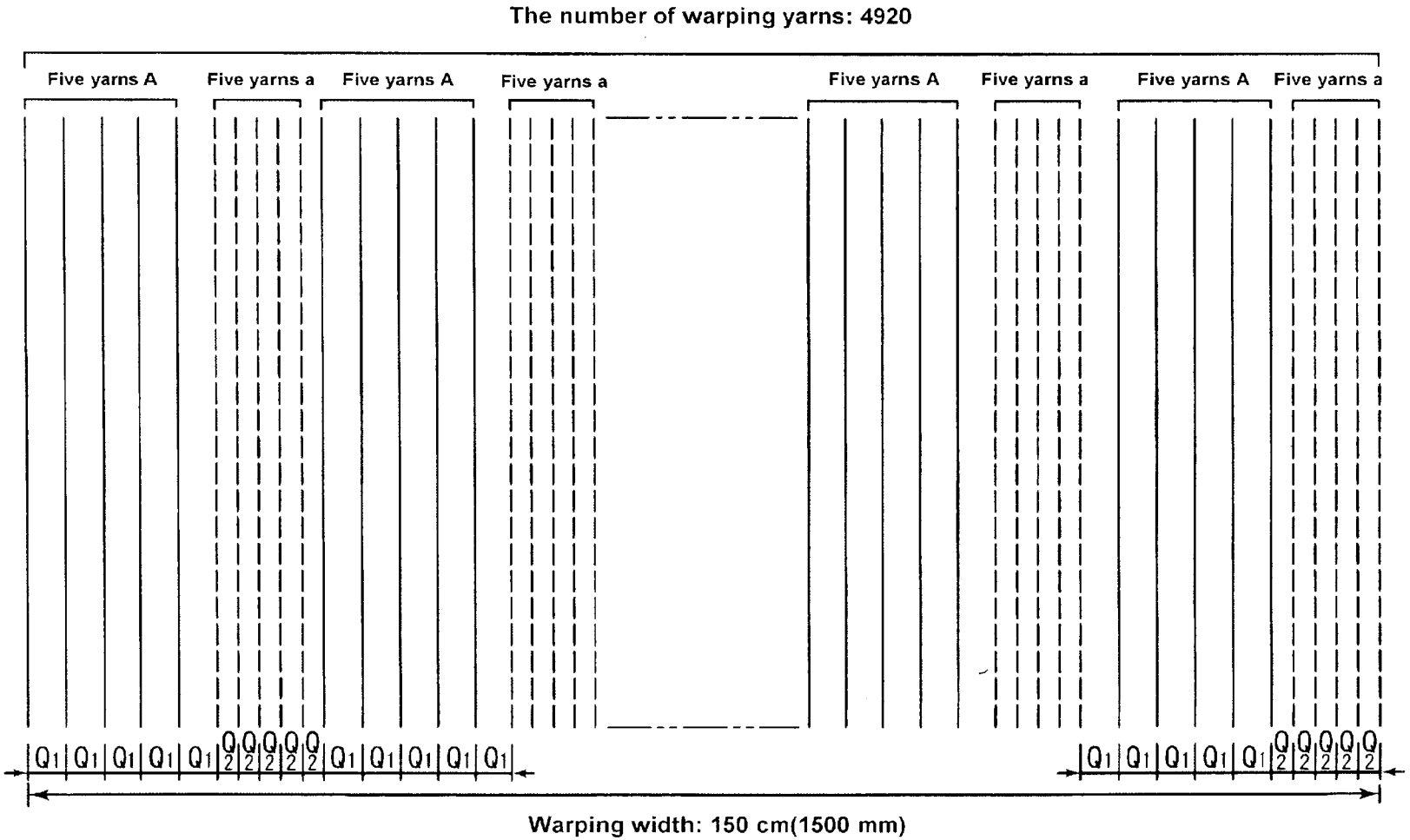
FIG. 2 is an explanatory view schematically showing an example of yarn intervals of a group of yarns warped according to the warping method of the present invention.
Figure 3:
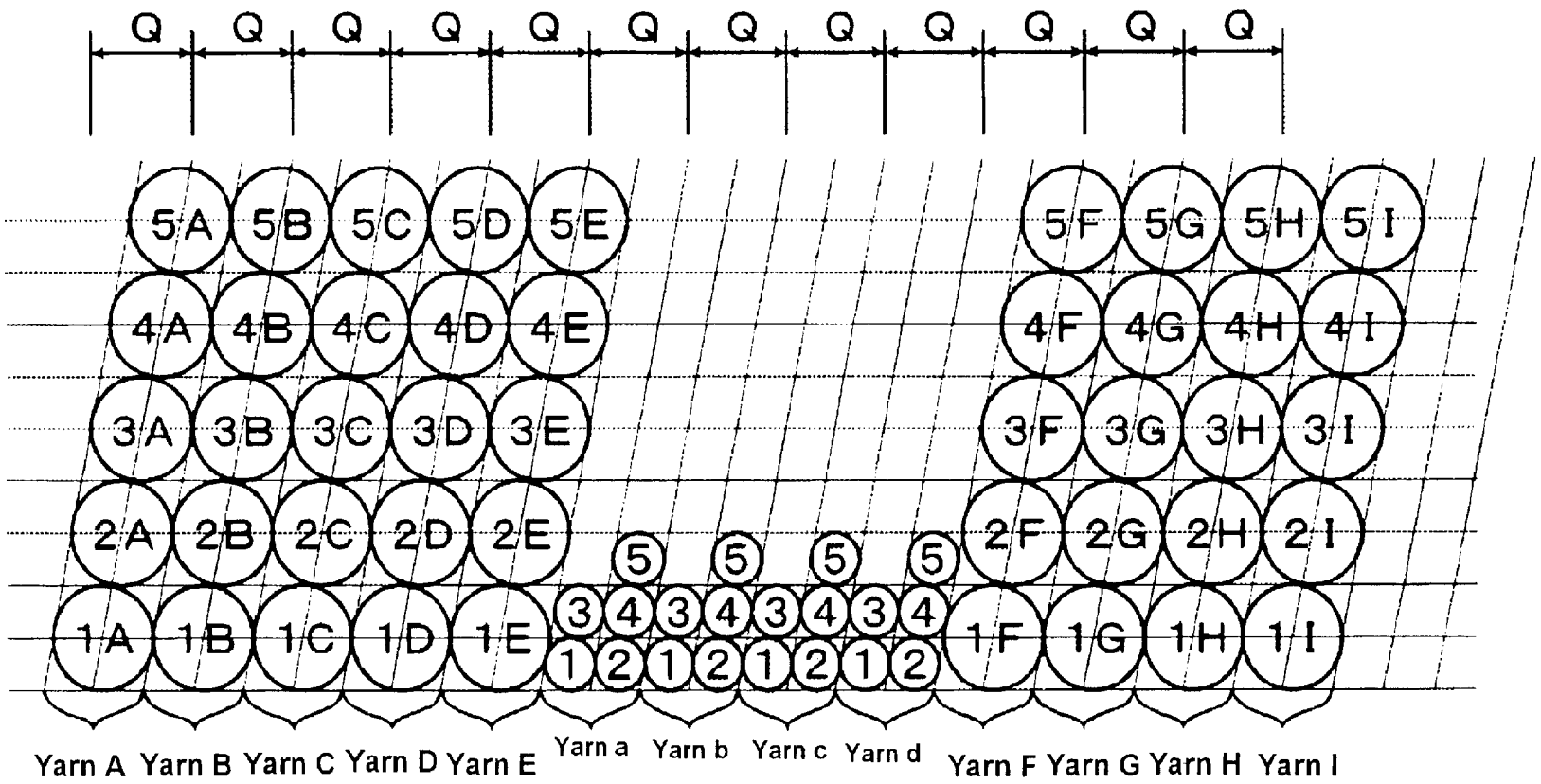
FIG. 3 is a sectional explanatory diagram showing an example of a wound contour of a group of yarns warped corresponding to a feed pitch of a conveyor belt in five windings of yarns warped according to a conventional method.
Figure 4:
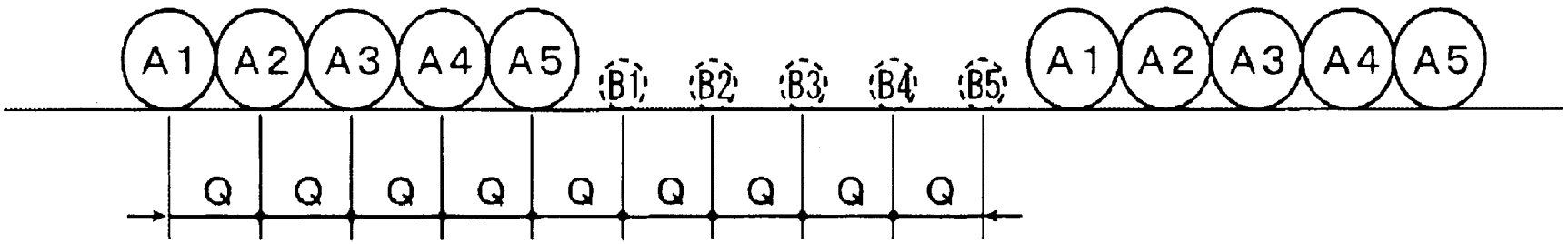
FIG. 4 is a sectional explanatory diagram showing another example of a wound contour of a group of yarns warped corresponding to a feed pitch of a conveyor belt in one winding of yarns warped according to the conventional method.
Figure 5:
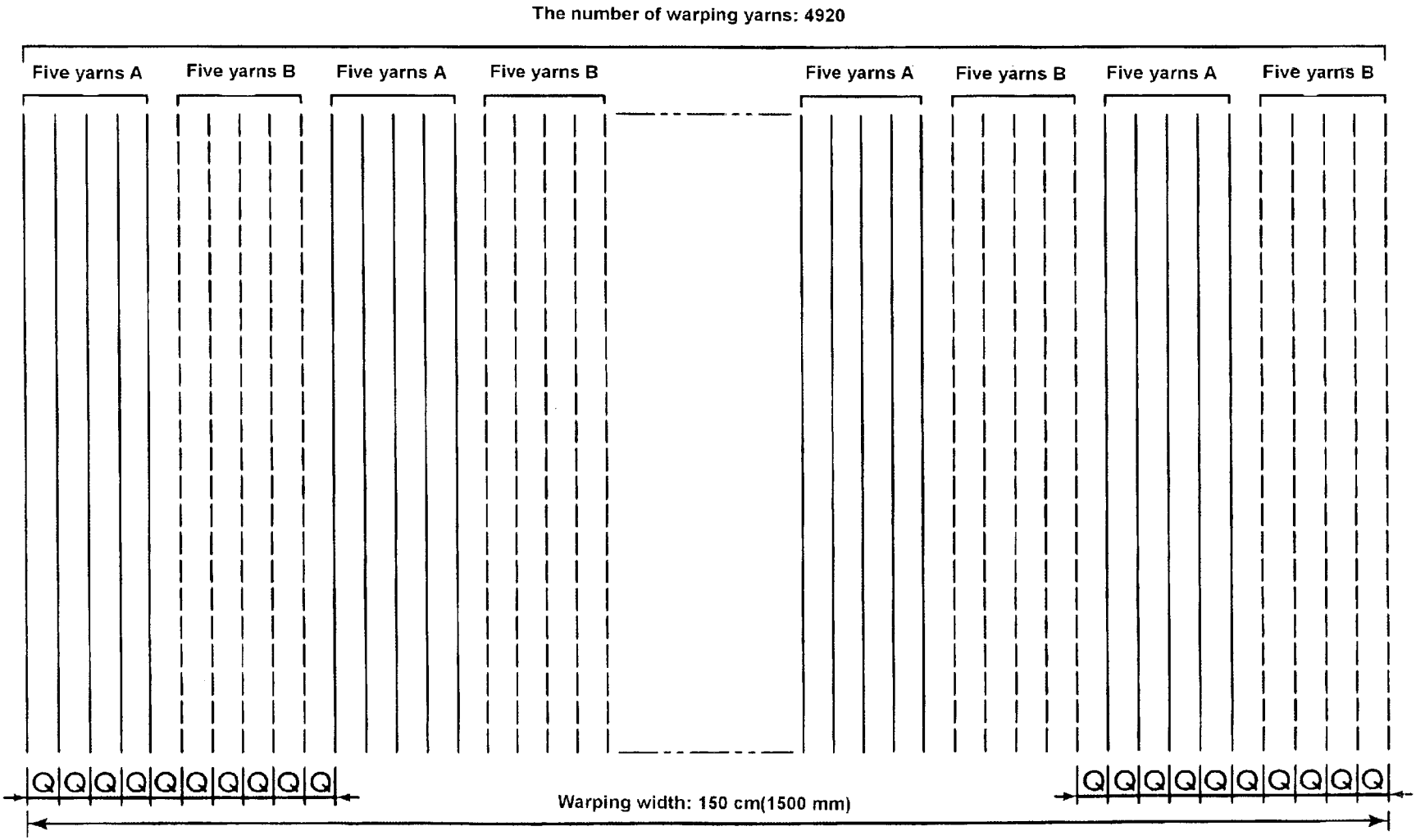
FIG. 5 is a schematic explanatory diagram showing an example of yarn intervals of a group of yarns warped according to the conventional method.
Figure 6:
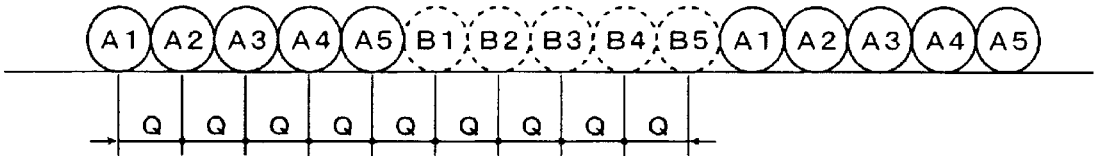
FIG. 6 is a sectional explanatory diagram showing still another example of a wound contour of a group of yarns warped corresponding to a feed pitch of a conveyor belt in one winding of yarns with the same count warped according to the conventional method.
Figure 7:
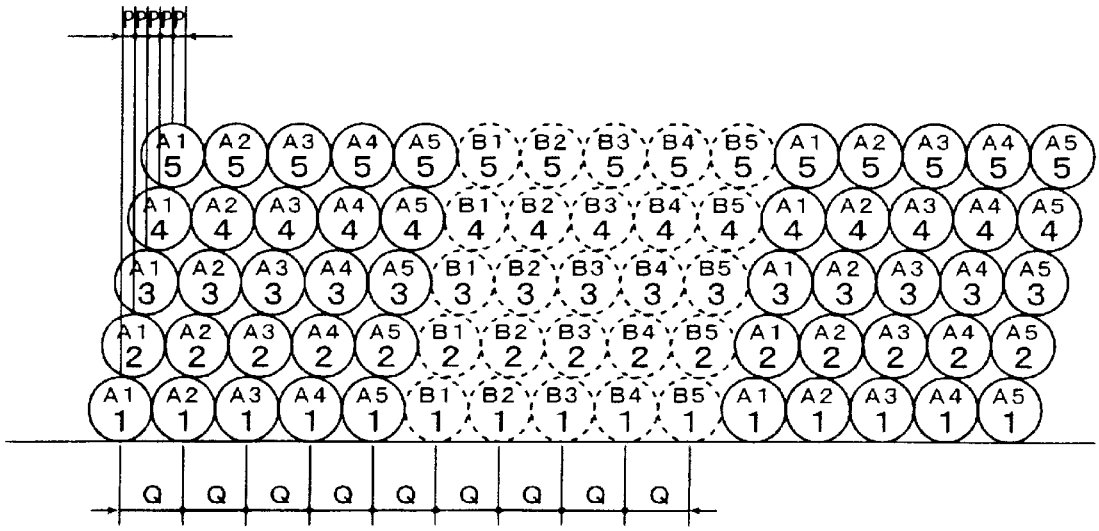
FIG. 7 is a sectional explanatory diagram showing a further example of a wound contour of a group of yarns warped corresponding to a feed pitch of a conveyor belt in five windings of yarns with the same count warped according to a conventional method.
Figure 8:
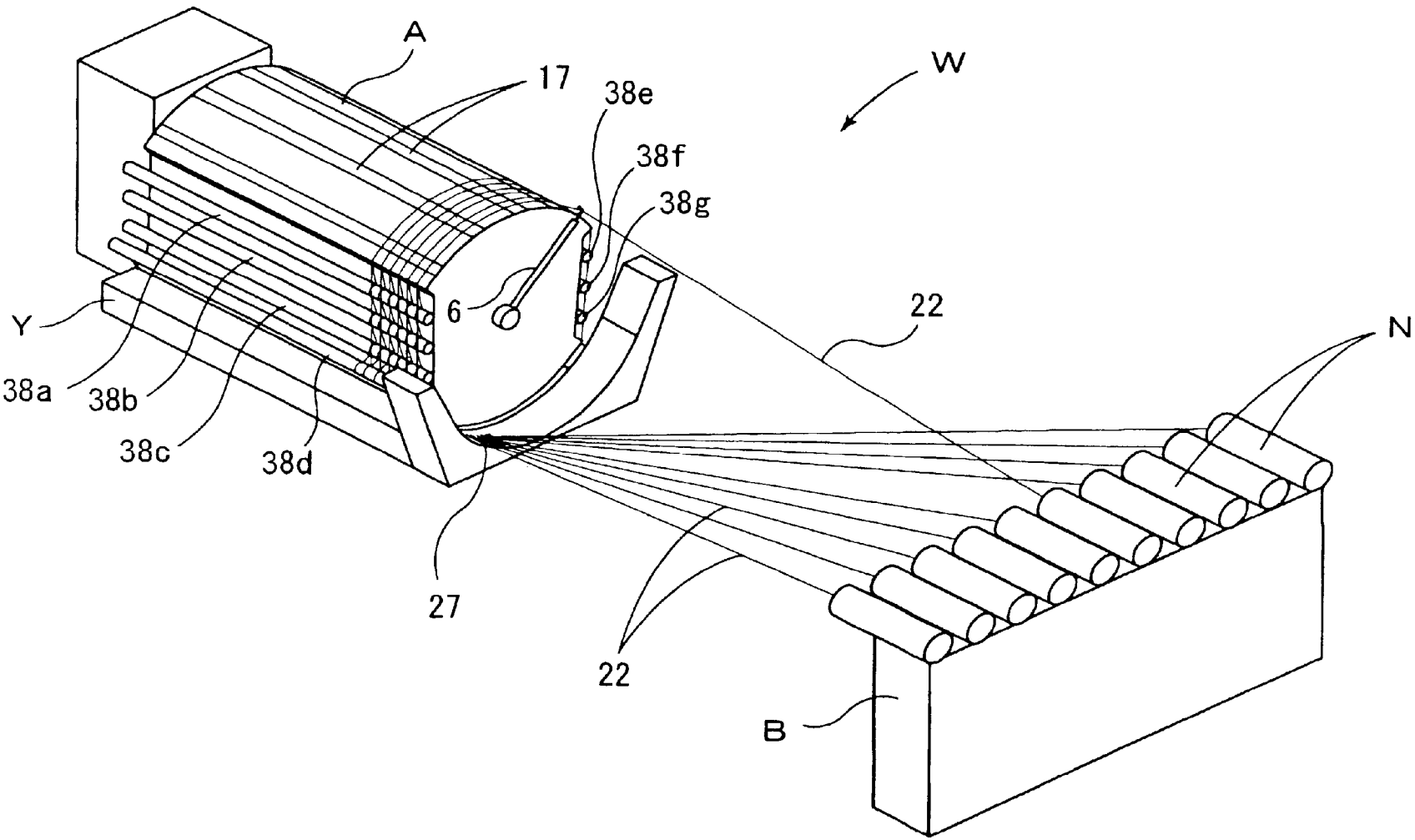
FIG. 8 is a perspective explanatory diagram showing a conventional sample warper.
Figure 9:
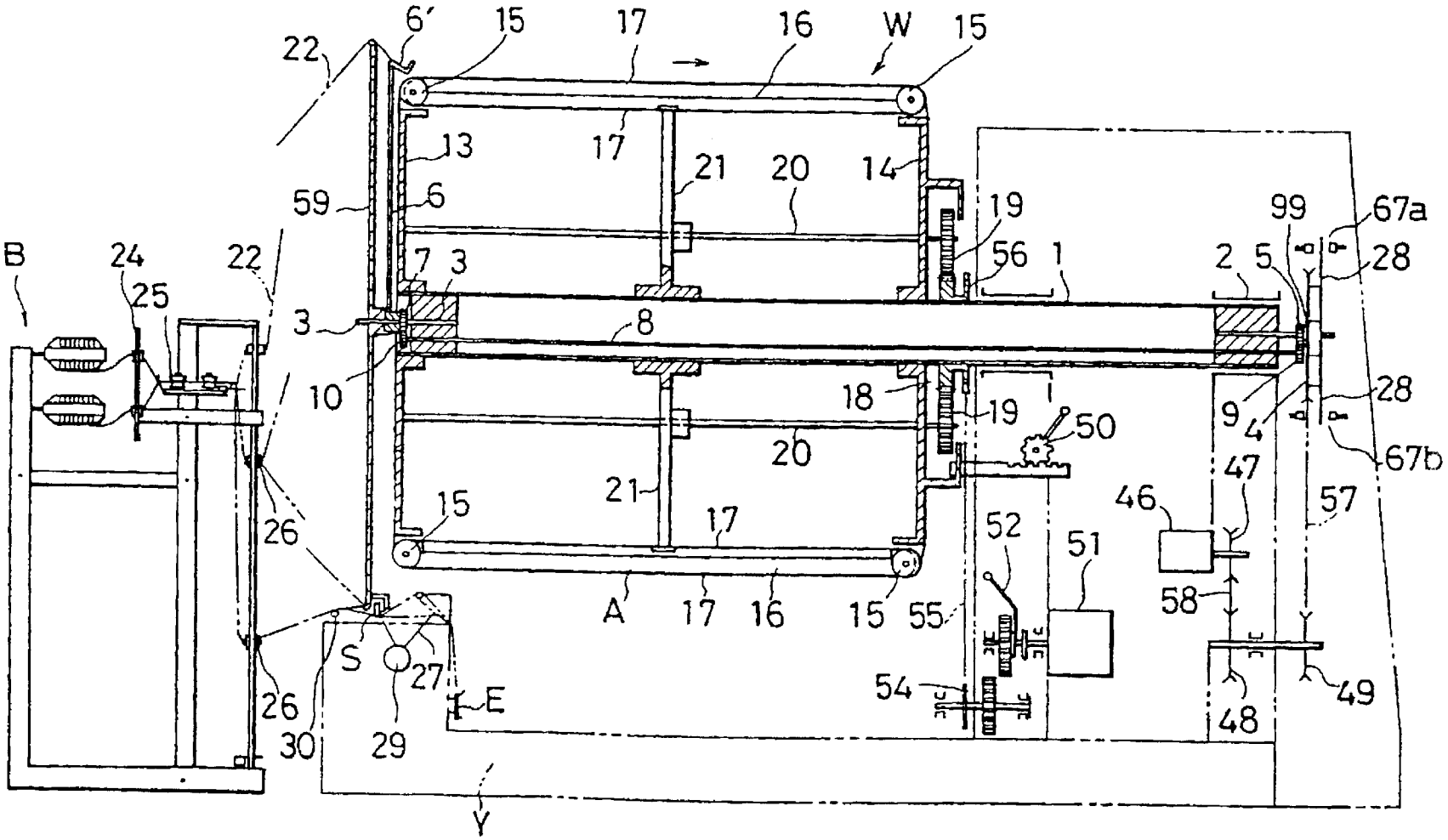
FIG. 9 is a schematic cross-sectional view of the conventional sample warper illustrated in FIG. 8.
Figure 10:
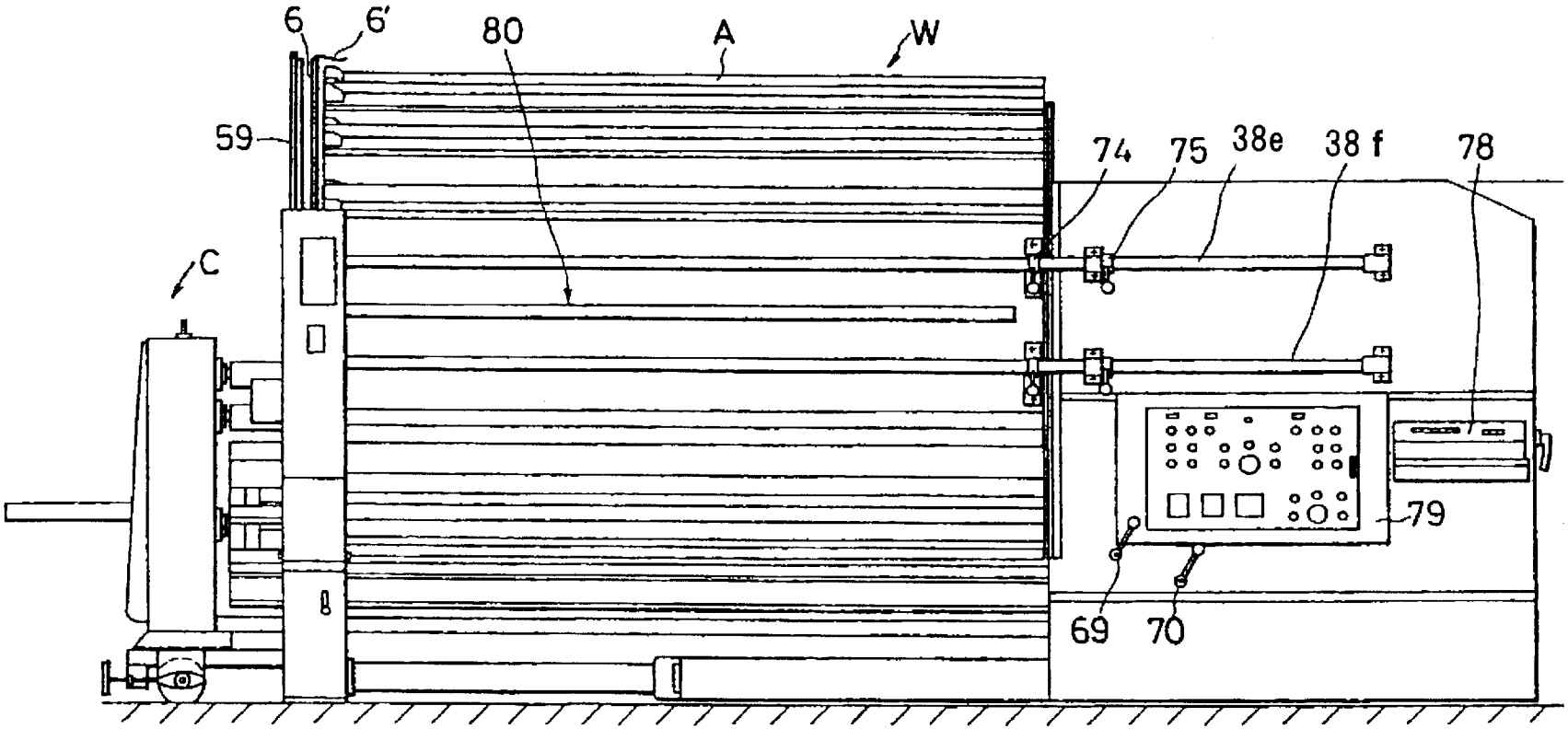
FIG. 10 is a schematic lateral view of the conventional sample warper illustrated in FIG. 8.

With reference to FIGS. 1 and 2, control of a feed rate of a conveyor belt in the present invention will be explained. For example, FIG. 2 shows a case where warping is performed according to feed of a novel conveyor belt in the present invention under a warping condition similar to that in FIG. 5.

Particularly, it has been found that, in performing six windings of No. 10 count yarns (A) and (B) (about 0.3 mm diameter), six windings of No. 40 count yarns (a) to (e) (about 0.15 mm diameter), and six windings of No. 10 count yarns (C) and (D) (about 0.3 mm diameter), respectively, it is necessary to obtain ($Q_1$), (Q2), ($P_1$) and ($P_2$) shown in FIG. 1 in order to achieve a flat state of yarns wound on a warper drum. That is, it is necessary to meet the conditions of ($Q_1$)=4×($Q_2$) and ($P_1$)=4×($P_2$). ($Q_1$) is an interval of the yarns (A) to (D), the interval being called as a warping density in this specification. ($Q_2$) is an interval of the yarns (a) to (e), the interval being called as a warping density in this specification. ($P_1$) is a value obtained by the warping density ($Q_1$) of the yarns (A) to (D) . the number of warping windings, and ($P_2$) is a value obtained by the warping density ($Q_2$) of the yarns (a) to (e)÷the number of warping windings, these values being referred to as a feed rate of a conveyor belt per revolution of a yarn introduction means in this specification.

In view of the diameter values of the yarns, ($Q_1$)=0.6 mm, ($Q_2$)=0.15 mm, ($P_1$)=0.1 mm, and ($P_2$)=0.025 mm can be obtained from FIG. 1. Also, the thickness of the yarns (A) to (D) wound on the drum is 0.3 mm×3=0.9 mm, and the thickness of the yarns (a) to (e) is 0.15 mm×6=0.9 mm.

From the above, it has been found that, assuming that the diameter of the yarn is (d) mm, the warping density is (Q), and the number of warping windings is (N), the thickness $H_N$ of the yarns wound on the drum can be calculated from the following equation (1).

$$H_N = d^2 \times \frac{1}{Q} \times N \tag{1}$$

Particularly, when the thickness ($H_6$) of the portion of the yarns (A) to (D) wound in FIG. 1 is calculated using the above equation (1), the following value is obtained, which corresponds to the above-mentioned value.

$$H_6 = (0.3)^2 \times \frac{1}{0.6} \times 6 = 0.9\,\text{mm}$$

Also, when the thickness ($H_6$) of the portion of the yarns (a) to (e) is calculated using the above equation (1), the following value is obtained, which corresponds to the above-mentioned value.

$$H_6 = (0.15)^2 \times \frac{1}{0.15} \times 6 = 0.9\,\text{mm}$$

Therefore, it is determined that the above equation (1) for calculation is correct.

The yarn thickness ($H_1$) of one winding on the warper drum can be calculated from the equation (1) according to the following equation (2).

$$H_1 = d^2 \times \frac{1}{Q} \tag{2}$$

Also, the thickness of the yarn in the case of one winding thereof will be explained as a thickness of one yarn layer in this specification.

From the above, it has been determined that, when yarns of different counts are warped, the warping density (Q) must be changed in order to flatten the surface state of the yarns wound on the warper drum.

Here, when yarns (A), (B), (C) of the counts of three kinds are warped on the warper drum, calculation equations of warping densities ($Q_A$), ($Q_B$), ($Q_C$) for flattening the surface state of the yarns (A), (B), (C) wound on the drum will be explained below. Assuming that the thickness of one layer of the yarn (A) is ($H_A$), the thickness of one layer of the yarn (B) is ($H_B$) and the thickness of one layer of the yarn (C) is ($H_C$), and the diameter of the yarn (A) is ($d_A$), the diameter of the yarn (B) is ($d_B$) and the diameter of the yarn (C) is ($d_C$), the following equations are obtained according to the above equation (2) .

$$H_A = d_A^2 \times \frac{1}{Q_A},\ H_B = d_B^2 \times \frac{1}{Q_B},\ H_C = d_C^2 \times \frac{1}{Q_C}$$

Since the above-mentioned condition is $H_A$=$H_B$=$H_C$, the following relational equation is established from the above equations.

$$\frac{d_A^2}{Q_A} = \frac{d_B^2}{Q_B} = \frac{d_C^2}{Q_C}$$

In the above equations, the following equations (3) are obtained.

$$\left.\begin{aligned} Q_A &= \frac{d_A^2}{d_B^2}\times Q_B \quad \text{or} \quad Q_A = \frac{d_A^2}{d_C^2}\times Q_C \\ Q_B &= \frac{d_B^2}{d_A^2}\times Q_A \quad \text{or} \quad Q_B = \frac{d_B^2}{d_C^2}\times Q_C \\ Q_C &= \frac{d_C^2}{d_B^2}\times Q_B \quad \text{or} \quad Q_C = \frac{d_C^2}{d_A^2}\times Q_A \end{aligned}\right\} \tag{3}$$

In the sample warper, however, when all the yarns have been warped, the conveyor belt on the warper drum must be moved by a preset warping width. For meeting this condition, when yarns (A), (B), (C) of three different counts are warped, assuming that the count of the yarn (A) to be warped is ($N_A$), the count of the yarn (B) to be warped is ($N_B$) and the count of the yarn (C) to be warped is ($N_C$), the warping density of the yarn (A) is ($Q_A$), the warping density of the yarn (B) is ($Q_B$) and the warping density of the yarn (C) is ($Q_C$), and the warping width is (W), the following equation(4) must be established.

$$W=N_A\times Q_A+N_B\times Q_B+N_C\times Q_C \tag{4}$$

When ($Q_A$) is obtained according to the above equation (4), the following equation is obtained.

$$W = N_A\times Q_A + N_B\times\frac{d_B^2}{d_A^2}\times Q_A + N_C\times\frac{d_C^2}{d_A^2}\times Q_A$$

Arranging ($Q_A$) in the above equation, the following equation is obtained.

$$W = Q_A\left(N_A + N_B\times\frac{d_B^2}{d_A^2} + N_C\times\frac{d_C^2}{d_A^2} + \ldots\right)$$

($Q_A$) is calculated according to the following equation (5).

$$Q_A = \frac{W}{N_A + N_B\times\frac{d_B^2}{d_A^2} + N_C\times\frac{d_C^2}{d_B^2} + \ldots} \tag{5}$$

Also, when ($Q_B$) is obtained according to the above equation (4), the following equation is established.

$$W = N_A\times\frac{d_A^2}{d_B^2}\times Q_B + N_B\times Q_B + N_C\times\frac{d_C^2}{d_B^2}\times Q_B + \ldots$$

Arranging ($Q_B$) in the above equation, the following equation is obtained.

$$W = Q_B\left(N_A\times\frac{d_A^2}{d_B^2} + N_B + N_C\times\frac{d_C^2}{d_B^2} + \ldots\right)$$

($Q_B$) can be obtained according to the following equation (6).

$$Q_B = \frac{W}{N_A + \frac{d_A^2}{d_B^2} + N_B + N_C\times\frac{d_C^2}{d_B^2} + \ldots} \tag{6}$$

Also, when ($Q_C$) is obtained according to the above equation (4), the following equation is established.

$$W = N_A\times\frac{d_A^2}{d_C^2}\times Q_C + N_B\times\frac{d_B^2}{d_A^2}\times Q_C + N_C\times Q_C\ldots$$

Arranging ($Q_C$) in the above equation, the following equation is obtained.

$$W = Q_C\left(N_A\times\frac{d_A^2}{d_C^2} + N_B\times\frac{d_B^2}{d_A^2} + N_C + \ldots\right)$$

($Q_C$) can be obtained according to the following equation (7).

$$Q_C = \frac{W}{N_A\times\frac{d_A^2}{d_C^2} + N_B\times\frac{d_B^2}{d_A^2} + N_C + \ldots} \tag{7}$$

The above calculated values are the warping densities ($Q_A$), ($Q_B$), ($Q_C$). By dividing these values by the number of warping windings, the conveyor belt feed rates ($P_A$), ($P_B$), ($P_C$) per revolution of the yarn introduction means can be easily calculated.

As disclosed in Japanese Patent No. 1529104, an AC servomotor is used as the motor for feeding the conveyor belt in the sample warper, and the number of pulses per revolution of the yarn introduction means to be sent to the motor is calculated on the basis of the warping width, the number of warping yarns and the number of warping windings, the servo motor being controlled via a position control board and a driver on the basis of the number of pulses. The present invention proposes calculation methods and calculation equations for improving a drawback occurring in the conventional sample warper where the conveyor belt feed rate per revolution of the yarn introduction means is the same pitch irrespective of the count of the yarn. In addition, the present invention proposes a sample warper where data about yarn kinds and counts are preliminarily stored in a setting device (such as a personal computer or the like) and when yarn kinds, counts, warping width, the number of warping yarns, the number of warping windings, and pattern data are input into the setting device, the number of yarns corresponding to each count (each yarn kind) is calculated and the number of pulses per revolution of the yarn introduction means is calculated according to the above-mentioned calculation equation by the setting device so as to send the calculated values to a position control board for controlling the feed rate of the servo motor, so that warping with a low warping density is performed in a thick yarn and warping with a high warping density is performed in a thin yarn. Incidentally, the above-mentioned calculation equations are utilized to calculate the above values in a computer or a calculator, the calculated values may individually be input to the sample warper.

According to the present invention, preliminarily inputting and storing yarn diameters corresponding to counts as one of data for warping and inputting counts together with a pattern data for warping, a conveyor belt feed pitch per revolution of a yarn introduction means is calculated so as to be suited for the counts of the yarns as well as a warping width, the number of warping yarns, and a warping length (the number of warping windings), and a conveyor belt feed pitch per revolution of the yarn introduction means, namely the conveyor belt feed rate, is controlled according to the counts of the yarns (thicknesses and diameters) so that a finished surface of the yarns wound on a warper drum is in a flat state without undulation, thereby solving the aforementioned troubles in the next weaving step.

Obviously various minor changes and modifications of the present invention are possible in the light of the above teaching. It is therefore to be understood that within the scope of the appended claims the invention may be practiced otherwise than as specifically described.

What is claimed is:

1. A sample warper comprising a warper drum, a conveyor belt moveable on the warper drum, means for moving the conveyor belt at a feed rate, at least one means for introducing yarns and exchanging yarns for winding the yarns on the conveyor belt moving on the warper drum at the feed rate to perform design warping, means for controlling the feed rate of the conveyor belt wherein when warping yarns of different counts (different thicknesses), the feed rate of the conveyor belt is controlled according to diameters (thicknesses) of the respective yarns so that a surface contour of the yarns wound on the warper drum is finished in a flat state irrespective of the yarn diameters of the different counts.

2. A sample warper according to claim 1, wherein the means for controlling the feed rate of the conveyor belt is operated such that when warping a thick yarn of a large diameter, the conveyor belt is moved with an increased feed rate, and when warping a thin yarn of a small diameter, the conveyor belt is moved with a decreased feed rate, so that the surface contour of the yarns wound on the warper drum can be finished in a flat state without undulation irrespective of the counts.

3. A warping method comprising the steps of catching yarns by at least one yarn introduction means and exchanging the yarns, winding the yarns on a conveyor belt moving on a warper drum at a feed rate to perform design warping, and when warping yarns of different counts (different thicknesses), controlling a feed rate of the conveyor belt according to diameters (thicknesses) of the respective yarns so that a surface contour of the yarns wound on the warper drum is finished in a flat state irrespective of the yarn diameters of the different counts.

4. A warping method according to claim 3, wherein controlling movement of the conveyor belt is such that when warping a thick yarn of a large diameter, the conveyor belt is moved with an increased feed rate, and when warping a thin yarn of a small diameter, the conveyor belt is moved with a decreased feed rate, so that the surface of yarns wound on the warper drum can be finished in a flat state without undulation irrespective of the counts.

5. A group of warped threads in which the threads comprise threads of different diameters (thicknesses) warped together on a warping drum such that the surface of the group of yarns is in a flat state so that the circumferential lengths of the respective yarn layers are the same comparing a thick yarn portion with a thin yarn portion resulting in no tension differences when the yarns wound on the warper drum are rewound onto a beam of a rewinder.

6. A group of warped yarns wherein a surface of yarns having different diameters of different counts wound on a warper drum is finished in a flat state by the steps of catching yarns by at least one yarn introduction means and exchanging the yarns; winding the yarns on a conveyor belt moving on a warper drum at a feed rate to perform design warping, and when warping yarns of different counts (different thicknesses), controlling a feed rate of the conveyor belt according to diameters (thicknesses) of the respective yarns so that a surface contour of the yarns wound on the warper drum is finished in a flat state irrespective of the yarn diameters of the different counts.

7. A group of warped yarns according to claim 6, made using the further steps of controlling movement of the conveyor belt such that when warping a thick yarn of a large diameter, the conveyor belt is moved with an increased feed rate, and when warping a thin yarn of a small diameter, the conveyor belt is moved with a decreased feed rate, so that the surface of yarns wound on the warper drum can be finished in a flat state without undulation irrespective of the counts.

* * * * *